US010393371B2

(12) United States Patent
Manrique et al.

(10) Patent No.: US 10,393,371 B2
(45) Date of Patent: Aug. 27, 2019

(54) GAS BURNER

(71) Applicant: WHIRLPOOL CORPORATION, Benton Harbor, MI (US)

(72) Inventors: Victor H. Manrique, St. Joseph, MI (US); Victor Gerardo Caloca, Benton Harbor, MI (US); Ana Katia Silva, Benton Harbor, MI (US); Tao Geng, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 133 days.

(21) Appl. No.: 15/395,557

(22) Filed: Dec. 30, 2016

(65) Prior Publication Data

US 2018/0187885 A1 Jul. 5, 2018

(51) Int. Cl.

*F23D 14/06* (2006.01)
*F23D 14/20* (2006.01)
*F23N 1/00* (2006.01)

(52) U.S. Cl.

CPC ..... *F23D 14/20* (2013.01); *F23D 14/06* (2013.01); *F23N 1/00* (2013.01); *F23N 1/007* (2013.01); *F23D 2203/00* (2013.01); *F23D 2900/14062* (2013.01); *F23D 2900/14064* (2013.01)

(58) Field of Classification Search

CPC ..... F23D 14/20; F23D 14/02; F23D 14/06; F23N 1/00

USPC ..... 126/39 E, 39 R, 29 N; 431/284, 326, 431/328–329

See application file for complete search history.

(56) References Cited

U.S. PATENT DOCUMENTS

| | | | | |
|---|---|---|---|---|
| 847,210 | A | 3/1907 | Maloney et al. | |
| 2,025,276 | A * | 12/1935 | Drezdon | F16K 5/106 137/614.17 |
| 2,573,502 | A | 10/1951 | Smith, Jr. | |
| 2,781,779 | A | 2/1957 | Kindl | |
| 5,368,476 | A * | 11/1994 | Sugahara | F23D 14/26 431/285 |
| 5,740,789 | A * | 4/1998 | Chang | F24C 3/126 126/39 K |
| 6,263,868 | B1 | 7/2001 | Koch et al. | |
| 6,318,357 | B1 | 11/2001 | Muhle et al. | |
| 6,332,460 | B1 | 12/2001 | Paesani | |

(Continued)

FOREIGN PATENT DOCUMENTS

| | | |
|---|---|---|
| EP | 0552135 A2 | 7/1993 |
| EP | 2447606 A1 | 5/2012 |

(Continued)

*Primary Examiner* — Vivek K Shirsat

(74) *Attorney, Agent, or Firm* — Price Heneveld LLP

(57) ABSTRACT

A burner unit includes first and second burner assemblies supplied with a gas mixture via first and second valves, respectively. A first valve control assembly controls the first and second valves between open and closed positions. Third and fourth burner assemblies of the burner unit are supplied with a gas mixture via third and fourth valves, respectively. A second valve control assembly controls the third and fourth valves between open and closed positions. The first and second valve control assemblies are separate assemblies that are configured to cooperate to simultaneously provide a gas mixture to the first, second, third and fourth burner assemblies in respective high power settings of the first and second valve control assemblies.

18 Claims, 6 Drawing Sheets

(56) References Cited

U.S. PATENT DOCUMENTS

| | | | | |
|---|---|---|---|---|
| 7,527,495 | B2 | 5/2009 | Yam et al. | |
| 7,878,800 | B2 | 2/2011 | Bettinzoli | |
| 8,978,637 | B2 | 3/2015 | Ryu et al. | |
| 9,206,986 | B2 | 12/2015 | Jeong et al. | |
| 2005/0142511 | A1 | 6/2005 | Yam et al. | |
| 2010/0252020 | A1 | 10/2010 | Siow | |
| 2012/0090595 | A1 | 4/2012 | Shaffer et al. | |
| 2013/0056663 | A1 | 3/2013 | Cadeau et al. | |
| 2013/0059256 | A1 | 3/2013 | Cadeau et al. | |
| 2013/0252183 | A1* | 9/2013 | Mueller | F23D 14/065 431/12 |
| 2015/0144123 | A1* | 5/2015 | Cadima | F24C 3/126 126/39 R |
| 2016/0025347 | A1 | 1/2016 | Cadima et al. | |
| 2016/0091210 | A1 | 3/2016 | Ceccoli | |

FOREIGN PATENT DOCUMENTS

| | | | |
|---|---|---|---|
| EP | 2551589 | A2 | 1/2013 |
| FR | 749529 | A | 7/1933 |
| GB | 2249383 | A | 5/1992 |
| WO | 03036168 | A1 | 5/2003 |

* cited by examiner

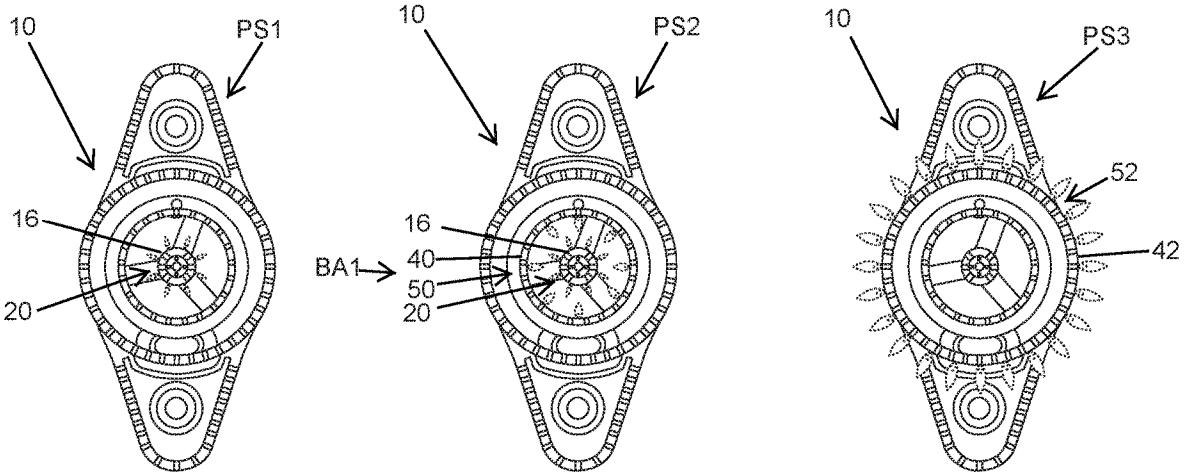
FIG. 4A
FIG. 4B
FIG. 4C
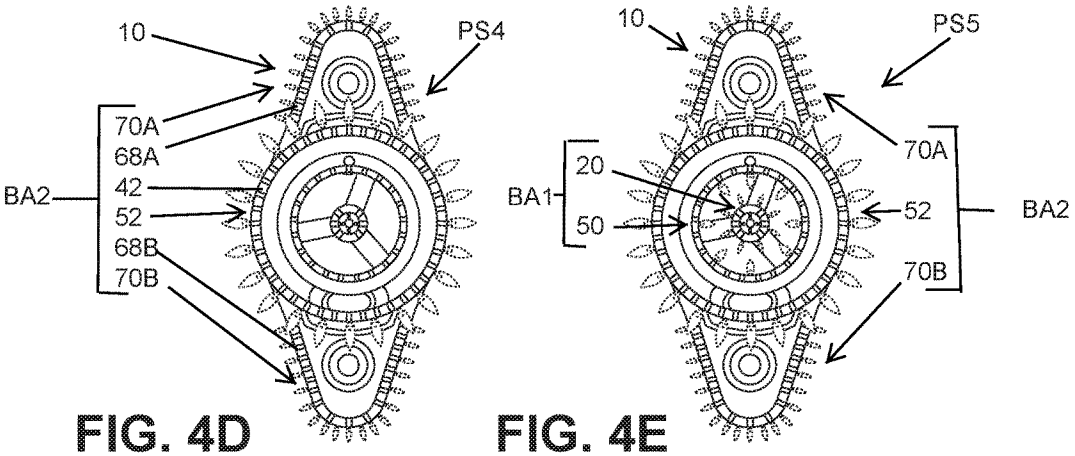
FIG. 4D
FIG. 4E

GAS BURNER

BACKGROUND

The present device generally relates to a gas burner unit, and particularly a gas burner unit that provides multiple configurations using a plurality of burners and multiple valve control assemblies to accommodate various cooking apparatuses.

SUMMARY

In at least one aspect, an appliance includes a burner unit having first and second sets of burner assemblies, wherein the second set of burner assemblies surrounds the first set of burner assemblies. First and second valves are fluidly coupled to the first set of burner assemblies. A first valve control assembly is configured to control the first and second valves of the first set of burner assemblies between open and closed positions. Third and fourth valves are fluidly coupled to the second set of burner assemblies. A second valve control assembly is configured to control the third and fourth valves of the second set of burner assemblies between open and closed positions.

In at least another aspect, a burner unit has a central body with a flame crown disposed thereon. An outer body is disposed around the central body, and includes inner and outer flame crowns disposed on opposite sides thereof. First and second lobes extend outwardly from the outer body, wherein the first and second lobes each include a flame crown disposed thereon. A first valve is fluidly coupled to the flame crown of the central body portion by a first supply line. A second valve is fluidly coupled to the inner flame crown of the outer body portion by a second supply line. A third valve is fluidly coupled to the outer flame crown of the outer body portion by a third supply line. A fourth valve is fluidly coupled to the flame crown of the first lobe and fluidly coupled to the flame crown of the second lobe.

In at least another aspect, a burner unit has first and second burner assemblies supplied with a gas mixture via first and second valves, respectively. A first valve control assembly controls the first and second valves between open and closed positions. Third and fourth burner assemblies are supplied with a gas mixture via third and fourth valves, respectively. A second valve control assembly controls the third and fourth valves between open and closed positions. The first and second valve control assemblies are separate assemblies that cooperate to simultaneously provide a gas mixture to the first, second, third and fourth burner assemblies in respective high power settings of the first and second valve control assemblies.

These and other features, advantages, and objects of the present device will be further understood and appreciated by those skilled in the art upon studying the following specification, claims, and appended drawings.

BRIEF DESCRIPTION OF THE DRAWINGS

In the drawings:

FIGS. 4A-4E are top plan views of the burner unit of FIG. 1 in different power configurations;

DETAILED DESCRIPTION OF EMBODIMENTS

Figure 1:
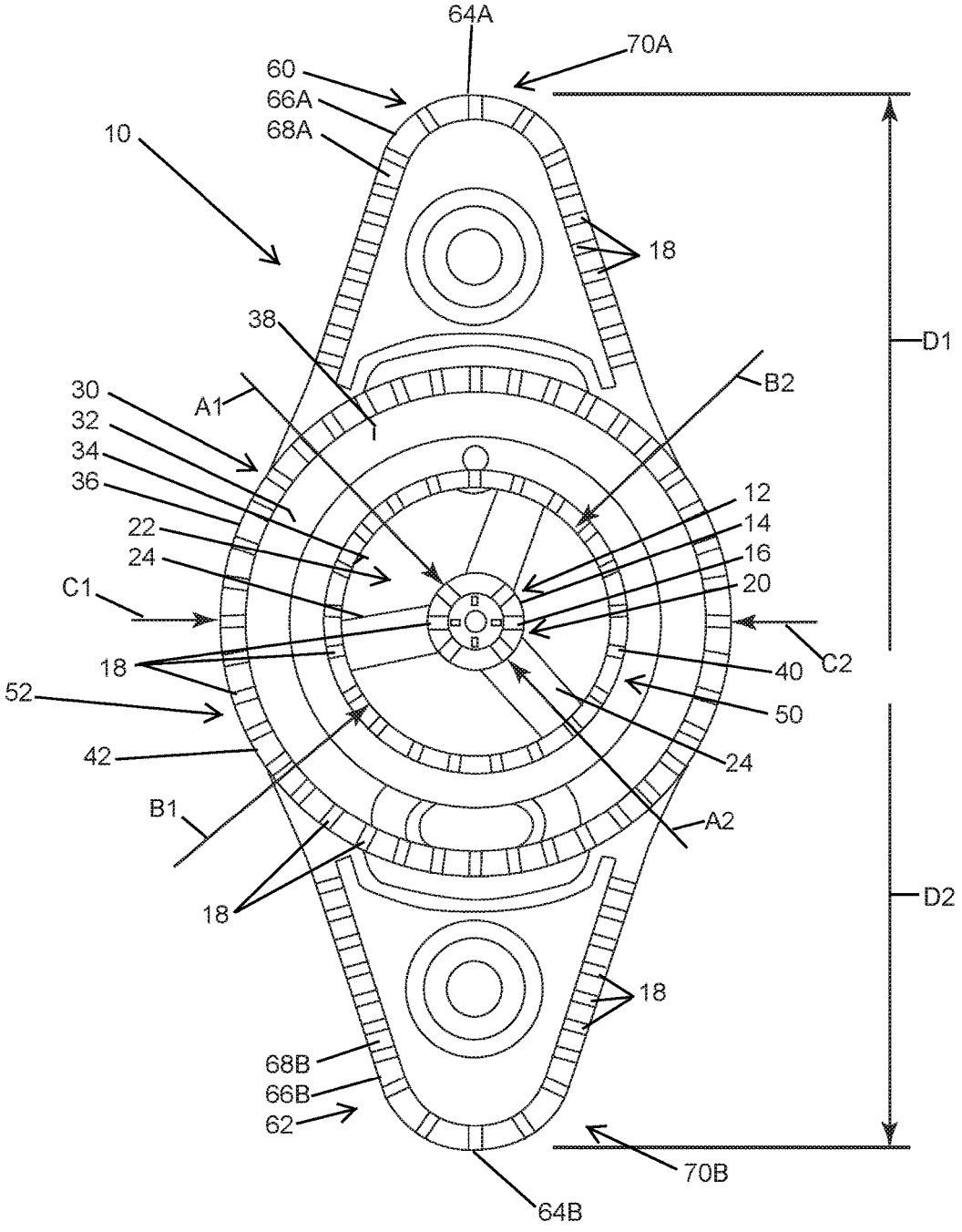
FIG. 1 is a top plan view of a burner unit according to one embodiment.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
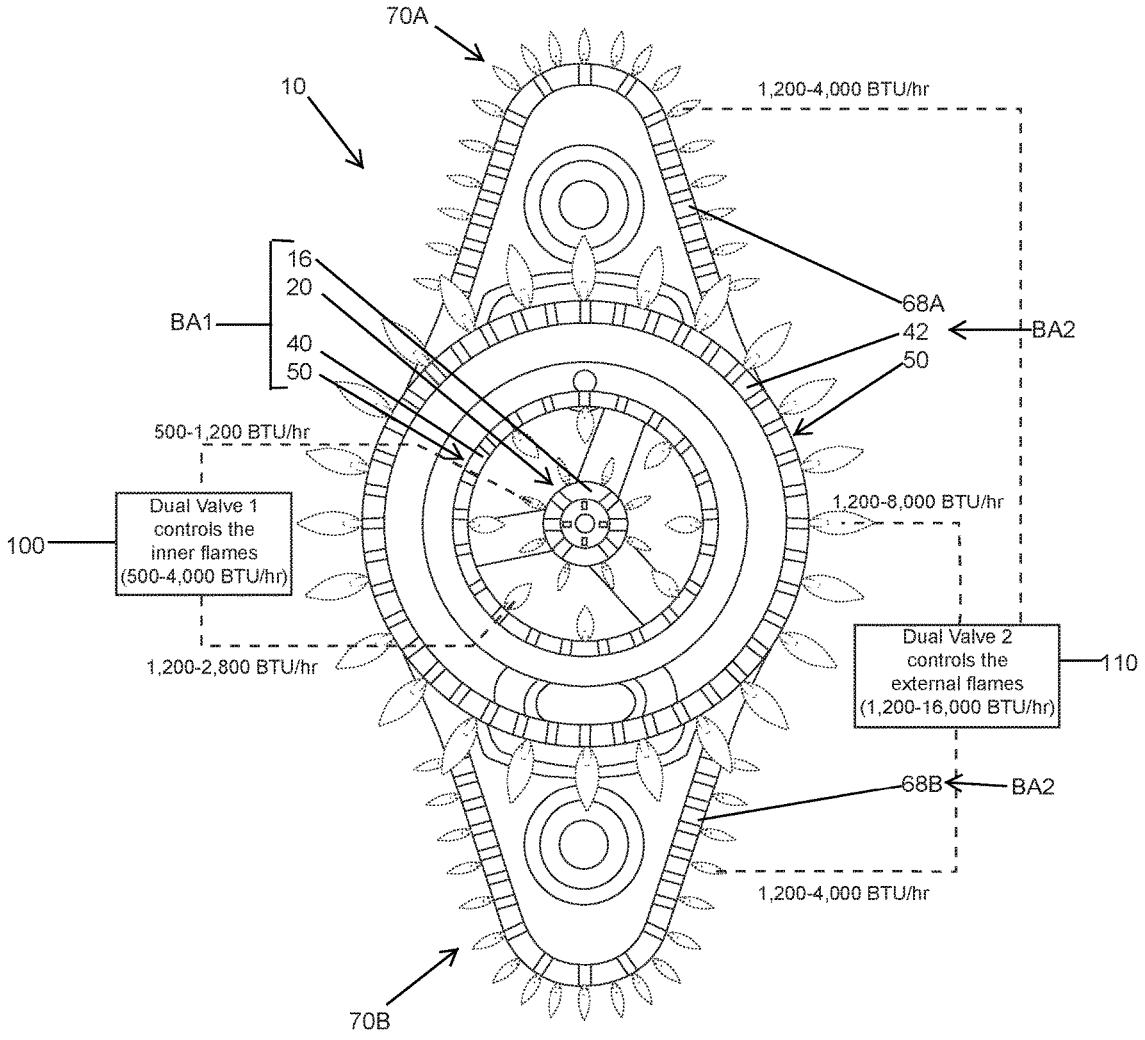
FIG. 3 is a top plan view of the burner unit of FIG. 2 showing first and second valve control assemblies.

Referring to the embodiment illustrated in FIG. 1, reference numeral 10 generally designates a burner unit having a plurality of flame crowns disposed thereon. Specifically, the burner unit 10 includes a central body 12 having a cylindrical shape with an outer perimeter 14. A flame crown 16 is disposed along the outer perimeter 14 of the central body 12 and defines an innermost and first flame crown of the burner unit 10. The flame crown 16 is comprised of and defined by a plurality of burner holes 18 which are spaced-apart along the outer perimeter 14 of the central body 12 in a substantially even distribution. The burner holes of the present concept are identified throughout this disclosure using reference numeral 18 and generally comprise the apertures through which flames are emitted when a gas mixture of a particular flame crown is ignited. Together, the central body 12 and the flame crown 16 define a first burner assembly 20 of the burner unit 10. The flame crown 16 of the first burner assembly 20 is shown as a circular flame crown and is contemplated to have a diameter of about 15-25 mm as defined between the head portions of arrows A1 and A2. It is contemplated that the flame crown 16 of the first burner assembly 20 can be used to provide a simmer feature for delicate cooking techniques where limited and precise temperature control is desired. It is contemplated that the flame crown 16 of the first burner assembly 20 alone is capable of generating approximately 500-1,200 BTUs (FIG. 3).

As further shown in FIG. 1, the burner unit 10 includes an outer body 30 in the form of a ring 32 having an inner perimeter 34 and an outer perimeter 36 with a connecting portion 38 disposed therebetween. As shown in FIG. 1, the outer body 30 is disposed around the central body 12 in a concentric manner, such that the central body 12 is nested within the ring 32 of the outer body 30. With the outer body 30 surrounding the central body 12, a spacing 22 exists between the outer body 30 and the central body 12. A plurality of braces 24 interconnects the outer body 30 and the central body 12. In use, the spacing 22 provides necessary airflow to the burner unit 10 to ensure proper ignition and burning. A flame crown 40 is disposed along the inner perimeter 34 of the outer body 30, defining an inner flame crown for the outer body 30 and a second flame crown of the burner unit 10. A flame crown 42 is disposed along the outer perimeter 32 of the outer body 30, defining an outer flame crown for the outer body 30 and a third flame crown of the burner unit 10. Much like the first flame crown 16, the flame crowns 40, 42 are comprised of and defined by a plurality of burner holes 18 which are spaced-apart along the inner and outer perimeters 34, 36 of the outer body 30 in a substantially even distribution. In the present concept, it is contemplated that the first flame crown 16 and the second flame crown 40 are controlled by a dual valve assembly, as further described below. Together, the outer body 30 and the second flame crown 40 define a second burner assembly 50 of the burner unit 10. Further, the outer body 30 and the third flame crown 42 define a third burner assembly 52 of the burner unit 10. The second and third flame crowns 40, 42 of the second and third burner assemblies 50, 52 are shown as a circular flame crowns and are contemplated to have diameters of about 45-55 mm and 90-110 mm as defined between the head portions of arrows B1, B2 and C1, C2, respectively. It is contemplated that the flame crown 40 of the second burner assembly 50 can be used to provide an auxiliary feature for delicate cooking techniques, such as chocolate melting (FIG. 2), where limited and precise temperature control is desired. It is contemplated that the flame crown 40 of the second burner assembly 50 alone is capable of generating approximately 1,200-2,800 BTUs (FIG. 3).

It is further contemplated that the flame crown 42 of the third burner assembly 52 can be used to provide a power flame feature (FIG. 2) for less delicate cooking techniques, such as boiling water, wherein maximum heat is desired. It is contemplated that the flame crown 42 of the third burner assembly 52 alone is capable of generating approximately 1,200-2,800 BTUs (FIG. 3).

With further reference to FIG. 1, the flame crowns 16, 40 and 42 are concentric with one another, wherein the flame crowns 16, 40 and 42 generally share a common center. While the flame crowns 16, 40 and 42 are shown as ring-shaped annular flame crowns in FIG. 1, other shapes are contemplated for use with the present concept, such that the present concept is not limited to the exemplary embodiment shown in FIG. 1.

Figure 2:
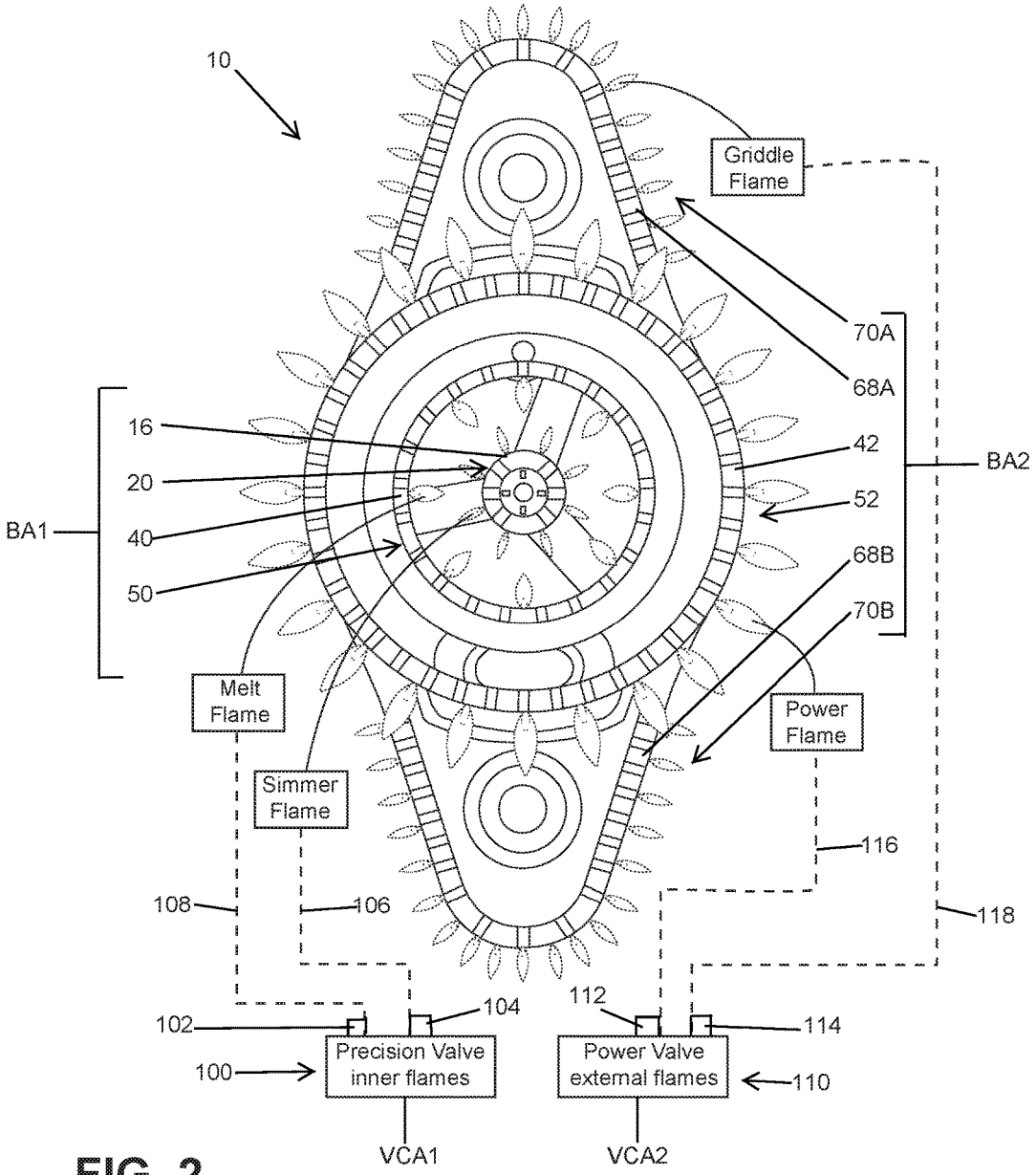
FIG. 2 is a top plan view of the burner unit of FIG. 1 showing multiple flames disposed around a plurality of flame crowns.

With further reference to FIG. 1, the outer body 30 includes first and second lobes 60, 62 extending outwardly therefrom. Specifically, in FIG. 1, the first and second lobes 60, 62 extend outwardly from the outer perimeter 36 of the outer body 30. The first and second lobes 60, 62 include end portions 64A, 64B, respectively, and outer perimeters 66A, 66B, respectively. The first and second lobes 60, 62 further include flame crowns 68A, 68B disposed along the outer perimeters 66A, 66B, respectively. Much like the flame crowns 16, 40 and 42 described above, the flame crowns 68A, 68B are comprised of and defined by a plurality of burner holes 18 which are spaced-apart along the outer perimeters 66A, 66B of the first and second lobes 60, 62 in a substantially even distribution. From the end portions 64A, 64B, with the central body 12 and outer body 30 disposed in between, the first and second lobes 60, 62 generally span a distance of approximately 100-210 mm as indicated between head portions of arrows D1 and D2. In this way, the first and second lobes 60, 62 provide a wide distribution area well-suited for use with a large cooking vessel, such as a stock pot or griddle pan (FIG. 2). The flame crowns 68A, 68B of the first and second lobes 60, 62 cooperate to define a fourth burner assembly as indicated by reference numerals 70A and 70B with respect to the separated flame crowns 68A, 68B of the first and second lobes 60, 62. It is contemplated that the flame crowns 68A, 68B of the fourth burner assembly 70A, 70B are each capable of generating approximately 1,200-4000 BTUs (FIG. 3). It is further contemplated that the fourth burner assembly 70A, 70B can be a continuous unit which surrounds the first, second and third burner assemblies 20, 50 and 52 in assembly.

Referring now to FIG. 2, the burner unit 10 is contemplated to include first and second valve assemblies 100, 110. The first valve assembly 100 includes first and second valves 102, 104, while the second valve assembly 110 includes third and fourth valves 112, 114. In this way, the first and second valve assemblies 100, 110 are dual valve assemblies, each having two valves. The valves 102, 104, 112, 114 are operable between open and closed positions (and a variety of intermediate positions therebetween) for controlling a gas and air mixture supplied to specific flame crowns of the burner unit 10 to which the valves are fluidly coupled. The term "fluidly coupled", as used herein, means that a valve is coupled to a flame crown along a gas supply line to that flame crown. The first valve assembly 100 is controlled by a first valve control assembly VCA1 for opening and closing the first and second valves 102, 104, and the second valve assembly 110 is controlled by a second valve control assembly VCA2 for opening and closing the third and fourth valves 112, 114. The first and second valve control assemblies VCA1, VCA2 are further described below with reference to FIGS. 6A and 6B.

As further shown in FIG. 2, the first valve assembly 100 is configured to control the simmer flame option and the melt flame option of the burner unit 10 at flame crowns 16 and 40 respectively. Specifically, the first valve 102 of the first valve assembly 100 controls a gas mixture supply provided to the first burner assembly 20 at flame crown 16 via supply line 106. The second valve 104 of the first valve assembly 100 controls a gas mixture supply provided to the second burner assembly 50 at flame crown 40 via supply line 108. In this way, the first valve assembly 100 controls a first set of burner assemblies BA1, wherein the first set of burner assemblies BA1 includes the first burner assembly 20 and the second burner assembly 50 along with the respective flame crowns 16, 40.

As further shown in FIG. 2, the second valve assembly 110 is configured to control the power flame option and the griddle flame option of the burner unit 10 at flame crowns 42 and 68A, 68B, respectively. Specifically, the third valve 112 of the second valve assembly 110 controls a gas mixture supply provided to the third burner assembly 52 at flame crown 42 via supply line 116. The fourth valve 114 of the second valve assembly 110 controls a gas mixture supply provided to the fourth burner assembly 70A, 70B at flame crowns 68A, 68B via supply line 118. In this way, the second valve assembly 110 controls a second set of burner assemblies BA2, wherein the second set of burner assemblies BA2 includes the third burner assembly 52 and the fourth burner assembly 70A, 70B along with the respective flame crowns 42, 68A and 68B.

Referring now to FIG. 3, the first valve assembly 100 is shown controlling the first set of burner assemblies BA1, which includes the first burner assembly 20 and the second burner assembly 50 along with the respective flame crowns 16, 40. The second valve assembly 110 is shown controlling the second set of burner assemblies BA2, which includes the third burner assembly 52 and the fourth burner assembly 70A, 70B along with the respective flame crowns 42, 68A and 68B. Thus, the first valve assembly 100 controls a range of BTUs for the first set of burner assemblies BA1 that is contemplated to cover approximately 500-4,000 BTUs. The low end 500 BTU setting is provided by the first flame crown 16 of the first burner assembly 20 when operating alone on a low power setting. The high end 4,000 BTU setting is provided by the first flame crown 16 of the first burner assembly 20 and the second flame crown 40 of the second burner assembly 50 when operating together at high power settings.

With further reference to FIG. 3, the second valve assembly 110 is shown controlling the second set of burner assemblies BA2, thus, the second valve assembly 110 controls a range of BTUs for the second set of burner assemblies BA2 that is contemplated to cover approximately 1,200-16,000 BTUs. The low end 1,200 BTU setting is provided by the third flame crown 42 of the third burner assembly 52 when operating alone on a low power setting. The high end 16,000 BTU setting is provided by the third flame crown 42 of the third burner assembly 52 and the fourth flame crown 68A, 68B of the fourth burner assembly 70A, 70B when operating together at high power settings.

Referring now to FIG. 4A, the burner unit 10 is shown in a first power setting PS1, wherein a range of approximately 500-1,200 BTUs is provided by the first flame crown 16 of the first burner assembly 20 operating alone. In FIG. 4B, the burner unit 10 is shown in a second power setting PS2, wherein a range of approximately 1,700-4,000 BTUs is provided by the first flame crown 16 of the first burner assembly 20 and the second flame crown 40 of the second burner assembly 50 operating together. Thus, the first set of burner assemblies BA1 is shown operating in an "all-on" configuration at second power setting PS2.

Referring now to FIG. 4C, the burner unit 10 is shown in a third power setting PS3, wherein a range of approximately 1,200-8,000 BTUs is provided by the third flame crown 42 of the third burner assembly 52 operating alone. In FIG. 4D, the burner unit 10 is shown in a fourth power setting PS4, wherein a range of approximately 3,600-16,000 BTUs is provided by the third flame crown 42 of the third burner assembly 52 and the fourth flame crown 68A, 68B of the fourth burner assembly 70A, 70B operating together. Thus, the second set of burner assemblies BA2 is shown operating in an "all-on" configuration at fourth power setting PS4.

Figure 5:
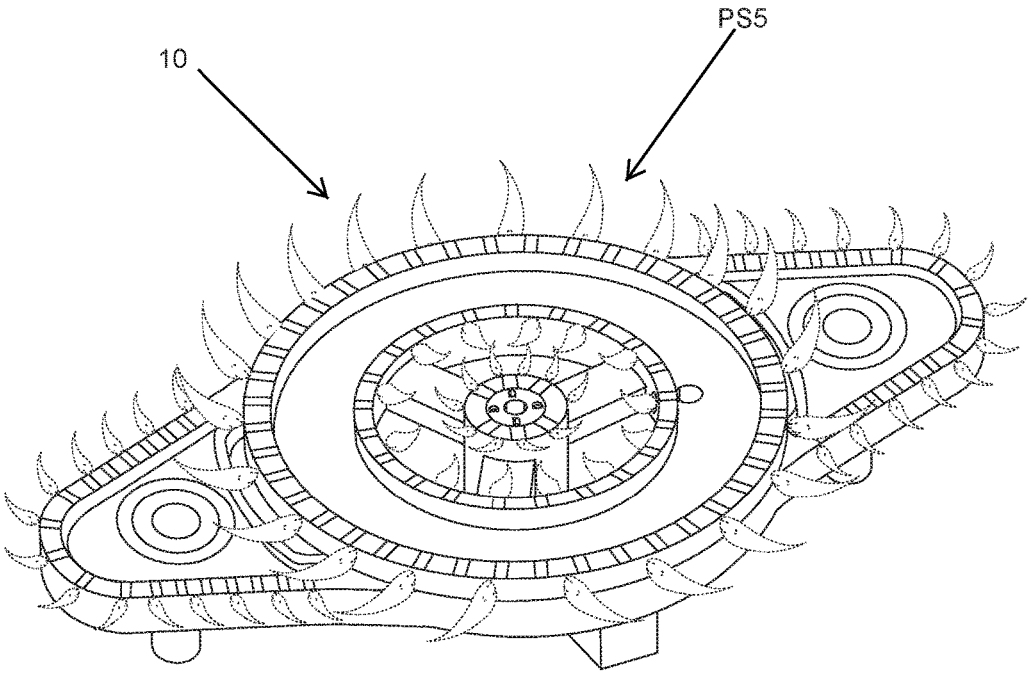
FIG. 5 is a top perspective view of the burner unit of FIG. 2.

Referring now to FIG. 4E, the burner unit 10 is shown in a fifth power setting PS5, wherein a range of approximately 5,300-20,000 BTUs is provided by the first, second, third and fourth flame crowns 16, 40, 42, and 68A, 68B of the first, second, third and fourth burner assemblies 20, 50, 52 and 70A, 70B operating together. Thus, in the fifth power setting PS5 shown in FIG. 4E, both the first and second sets of burner assemblies BA1, BA2 are shown operating in "all-on" configurations. The fifth power setting PS5 is also shown in the burner unit 10 of FIG. 5. In the fifth power setting PS5, it is contemplated that the first and second valve assemblies 100, 110 have all valves 102, 104, 112 and 114 open to supply gas for combustion at the flame crowns 16, 40, 42, and 68A, 68B of the first, second, third and fourth burner assemblies 20, 50, 52 and 70A, 70B.

Figure 6B:
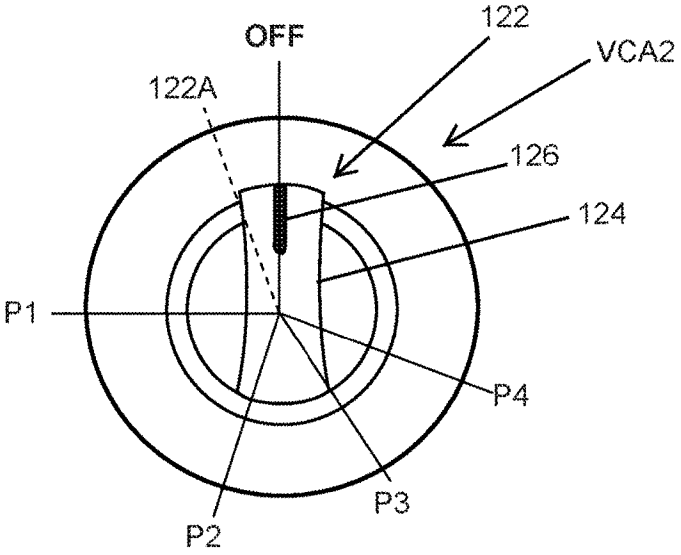
FIG. 6B is a top plan view of a first valve control assembly.
Figure 6A:
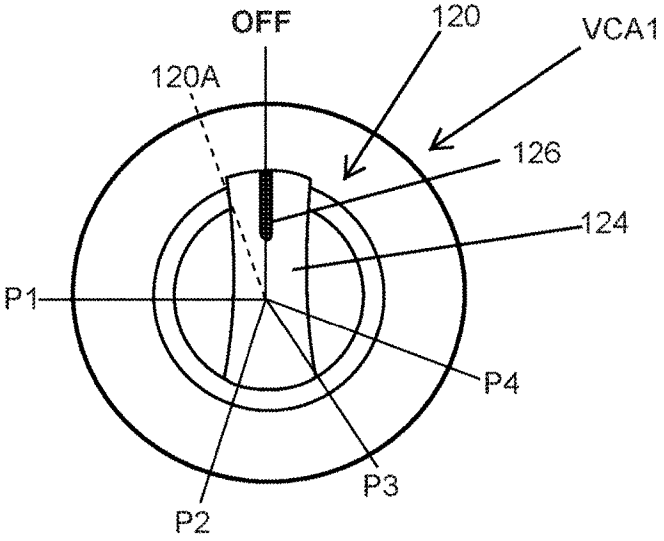
FIG. 6A is a top plan view of a first valve control assembly.

Referring now to FIGS. 6A and 6B, the first and second valve control assemblies VCA1, VCA2 are shown on the form knobs 120, 122 contemplated to be disposed on an outer surface of a cooking appliance in which the burner unit 10 is disposed. The knobs 120, 122 are contemplated to be rotatable knobs that are configured to control the first and second valve assemblies 100, 110 (FIGS. 2 and 3), which are dual valve assemblies which have first and second valves 102, 104 and third and fourth valves 112, 114, respectively. As noted above, with reference to FIG. 2, the first and second valve control assemblies VCA1, VCA2 is operably coupled to the first and second valve assemblies 100, 110 for controlling the same. The coupling of the first and second valve control assemblies VCA1, VCA2 to the first and second valve assemblies 100, 110 is contemplated to be achieved using mechanical or electrical means known in the art for selectively opening and closing valves using a knob-like control. It is further contemplated that the first and second valve control assemblies VCA1, VCA2 can be substantially electronic assemblies having digital displays and electronic buttons. In the description below, the first and second valve control assemblies VCA1 and VCA2 will be described as having "positions" to which the knobs 120, 122 can be rotated for initiating various power settings of the burner unit 12. It is contemplated that the first and second valve control assemblies VCA1 and VCA2 can be operated by means other than a rotatable knob for initiating the power settings of the present concept, such that term "position" is interchangeable with a configuration for a non-mechanical control assembly.

With further reference to FIGS. 6A and 6B, the knobs 120, 122 each include handle portions 124 having indicators 126 used to indicate a position to which the knobs 120, 122 are rotated. Each knob 120, 122 is shown in FIGS. 6A, 6B in an OFF position. With specific reference to FIG. 6A, the knob 120 of the first valve control assembly VCA1 includes a starting position 120A which is contemplated to light a specific burner assembly, and/or a pilot light feature. After ignition at the starting position 120A, the knob 120 is rotatable to a first position P1 which is contemplated to be a high simmering power setting which opens the first valve 102 of the first valve assembly 100 and ignites the first flame crown 16 of the first burner assembly 20. The first flame crown of the 16 of the first burner assembly 20 operates alone from the first position P1 to a second position P2 (a low simmering power setting) at a range of about 500-1,200 BTUs for a first power setting PS1 as shown in FIG. 4A. Movement of the knob 120 to the first position P1, opens the first valve 102 of the first valve assembly 100 for supplying a gas mixture to the first burner assembly 20. Movement of the knob 120 from the first position P1 to the second position P2, partially closes the first valve 102 of the first valve assembly 100. From the second position P2, the knob 120 is rotatable to a third position P3 which is contemplated to open the first and second valves 102 and 104 of the first valve assembly 100 to simultaneously light the flame crown 16 of the first burner assembly 20 and the flame crown 40 of the second burner assembly 50. The first and second flame crowns 16, 40 of the first set of burner assemblies BA1 operate from the third position P3 (a high auxiliary power setting) to a fourth position P4 (a low auxiliary power setting) at a range of about 1,700-4,000 BTUs to define the second power setting PS2 as shown in FIG. 4B.

With specific reference to FIG. 6B, the knob 122 of the second valve control assembly VCA2 includes a starting position 122A which is contemplated to light a specific burner assembly, and/or a pilot light feature. After ignition at the starting position 122A, the knob 122 is rotatable to a first position P1 which is contemplated to be a high semi-rapid heat power setting which opens the third valve 112 of the second valve assembly 110 and ignites the third flame crown 42 of the third burner assembly 52. The third flame crown 42 of the third burner assembly 52 operates alone from the first position P1 to a second position P2 (a low semi-rapid heat power setting) at a range of about 1,200-8,000 BTUs for a third power setting PS3 as shown in FIG. 4C. Movement of the knob 122 to the first position P1, opens the third valve 112 of the second valve assembly 110 for supplying a gas mixture to the third burner assembly 52. Movement of the knob 122 from the first position P1 to the second position P2, partially closes the third valve 112 of the second valve assembly 110. From the second position P2, the knob 122 is rotatable to a third position P3 which is contemplated to open the third and fourth valves 112 and 114 of the second valve assembly 110 to simultaneously light the flame crown of the 42 of the third burner assembly 52 and the flame crown 68A, 68B of the fourth burner assembly 70A, 70B. The third and fourth flame crowns 52 and 68A, 68B of the second set of burner assemblies BA2 operate from the third position P3 (a high rapid heat power setting) to a fourth position P4 (a low rapid heat power setting) at a range of about 3,600-16,000 BTUs to define the fourth power setting PS4 as shown in FIG. 4D.

As noted above, the burner unit 10 of the present concept includes dual controls VCA1 and VCA2 for controlling dual valve assemblies 100, 110 on a single burner unit. The first and second valve control assemblies VCA1 and VCA2 can be used separately, as described above, or they can be used together to provide an ultra-rapid heat setting which correlates to power setting PS5 shown in FIG. 4E. For using first and second valve control assemblies VCA1 and VCA2 together, the first valve control assembly VCA1 will have the knob 120 disposed at the third position P3 which is contemplated to open the first and second valves 102 and 104 of the first valve assembly 100 to simultaneously light the flame crown of the 16 of the first burner assembly 20 and the flame crown 40 of the second burner assembly 50. The second valve control assembly VCA2 will have the knob 122 disposed at the third position P3 as well, which is contemplated to open the third and fourth valves 112 and 114 of the second valve assembly 110 to simultaneously light the flame crown 42 of the third burner assembly 52 and the flame crown 68A, 68B of the fourth burner assembly 70A, 70B. In this way, the burner unit 10 has all four flame crowns 16, 40, 42 and 68A, 68B lit for generating BTUs in a range of about 5,300-20,000 BTUs as the first and second knobs 120, 122 move between the third positions P3 and the fourth positions P4. Thus, the dual control features of the burner unit 10 provide for a highly configurable burner unit to provide the precise configuration needed for a particular cooking or food preparation procedure.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A burner unit, comprising:

a first set of burner assemblies, wherein the first set of burner assemblies includes a first burner assembly having a first flame crown and a second burner assembly having a second flame crown;

a second set of burner assemblies surrounding the first set of burner assemblies, wherein the second set of burner assemblies includes a third burner assembly having a third flame crown and a fourth burner assembly having a fourth flame crown;

first and second valves fluidly coupled to the first set of burner assemblies;

a first valve control assembly configured to selectively control the first and second valves of the first set of burner assemblies between open and closed positions;

third and fourth valves fluidly coupled to the second set of burner assemblies; and a second valve control assembly configured to selectively control the third and fourth valves of the second set of burner assemblies between open and closed positions.

2. The burner unit of claim 1, wherein the first and second flame crowns are circular flame crowns that are concentric with one another, the second flame crown disposed around the first flame crown.

3. The burner unit of claim 2, wherein the third flame crown is a circular flame crown that is concentric with the first and second flame crowns, the third flame crown disposed around the second flame crown.

4. The burner unit of claim 3, wherein the fourth burner assembly includes first and second lobes outwardly extending from the third burner assembly on opposite sides thereof.

5. The burner unit of claim 1, wherein the first valve control assembly includes a first knob having first and second power settings.

6. The burner unit of claim 5, wherein the first power setting of the first knob opens the first valve for supplying a gas mixture to the first burner assembly of the first set of burner assemblies.

7. The burner unit of claim 6, wherein the second power setting of the first knob opens the second valve for supplying a gas mixture to the second burner assembly of the first set of burner assemblies.

8. The burner unit of claim 7, wherein the second valve control assembly includes a second knob having first and second power settings.

9. The burner unit of claim 8, wherein the first power setting of the second knob opens the third valve for supplying a gas mixture to the third burner assembly of the second set of burner assemblies.

10. The burner unit of claim 9, wherein the second power setting of the second knob opens the fourth valve for supplying a gas mixture to the fourth burner assembly of the second set of burner assemblies.

11. A burner unit, comprising:

a central body having a flame crown disposed thereon;

an outer body disposed around the central body, the outer body having inner and outer flame crowns disposed on opposite sides thereof;

first and second lobes extending outwardly from the outer body, wherein the first and second lobes each include a flame crown disposed thereon;

a first valve fluidly coupled to the flame crown of the central body portion by a first supply line, wherein the first valve is selectively operable between open and closed positions;

a second valve fluidly coupled to the inner flame crown of the outer body portion by a second supply line, wherein the second valve is selectively operable between open and closed positions;

a third valve fluidly coupled to the outer flame crown of the outer body portion by a third supply line, wherein the third valve is selectively operable between open and closed positions;

a fourth valve fluidly coupled to the flame crown of the first lobe and fluidly coupled to the flame crown of the second lobe, wherein the fourth valve is selectively operable between open and closed positions;

a first valve control assembly configured to independently control the first and second valves between the open and closed positions; and a second valve control assembly configured to independently control the third and fourth valves between the open and closed positions.

12. The burner unit of claim 11, wherein the central body and the outer body are annular structures that are concentric with one another, and further wherein the outer body is operably coupled to the central body by one or more braces.

13. The burner unit of claim 12, wherein the first valve control assembly includes first and second power settings, wherein the first power setting of the first valve control assembly controls an opening of the first valve for supplying a gas mixture to the flame crown of the central body.

14. The burner unit of claim 13, wherein the second power setting of the first valve control assembly controls an opening of the second valve for supplying a gas mixture to the inner flame crown of the outer body.

15. The burner unit of claim 14, including:

wherein the second valve control assembly includes first and second power settings, wherein the first power setting of the second valve control assembly controls an opening of the third valve for supplying a gas mixture to the outer flame crown of the outer body.

16. The burner unit of claim 15, wherein the second power setting of the second valve control assembly controls an opening of the fourth valve for supplying a gas mixture to the flame crowns of the first and second lobes.

17. A burner unit, comprising:

first and second burner assemblies supplied with a gas mixture via first and second valves, respectively, wherein the first and second valves are selectively operable between open and closed positions;

a first valve control assembly controlling the first and second valves between open and closed positions;

third and fourth burner assemblies supplied with a gas mixture via third and fourth valves, respectively, wherein the third and fourth valves are selectively operable between open and closed positions independent of the first and second valves; and a second valve control assembly controlling the third and fourth valves between open and closed positions, wherein the first and second valve control assemblies are separate assemblies that cooperate to simultaneously provide a gas mixture to the first, second, third and fourth burner assemblies in respective high power settings of the first and second valve control assemblies.

18. The burner unit of claim 17, wherein the first valve is in the open position when the second valve is in the open position and further wherein the third valve is in the open position when the fourth valve is in the open position.

* * * * *